US005338168A

United States Patent [19]

Kondoh et al.

[11] Patent Number: 5,338,168

[45] Date of Patent: Aug. 16, 1994

[54] OIL PUMP MADE OF ALUMINUM ALLOYS

[75] Inventors: Katsuyoshi Kondoh; Yoshinobu Takeda, both of Itami, Japan

[73] Assignee: Sumitomo Electric Industries, Ltd., Osaka, Japan

[21] Appl. No.: 82,930

[22] Filed: Jun. 29, 1993

[30] Foreign Application Priority Data

Jun. 29, 1992 [JP] Japan ..... 4-170904
Jun. 30, 1992 [JP] Japan ..... 4-172610

[51] Int. Cl.[5] ..... F04C 2/10; F04C 29/00

[52] U.S. Cl. ..... 418/179; 420/534; 420/535; 148/437

[58] Field of Search ..... 148/437, 439; 420/534, 420/535, 548; 418/179; 419/38, 44

[56] References Cited

U.S. PATENT DOCUMENTS 4,702,885 10/1987 Odani et al. ..... 419/23
4,838,936 6/1989 Akechi ..... 75/249
5,199,971 4/1993 Akechi et al. ..... 75/249

FOREIGN PATENT DOCUMENTS 60-147785 10/1985 Japan .
62-124284 8/1987 Japan .
4314983 11/1992 Japan .
539507 2/1993 Japan .

OTHER PUBLICATIONS

Patent Abstracts of Japan, vol. 12, No. 260 (M-720) Jul. 21, 1988 & JP-A-63 041 690 (Diesel Kiki Co. Ltd.) Feb. 22, 1988 * abstract*.

Patent Abstracts of Japan, vol. 12, No. 283 (C-518) Aug. 3, 1988 & JP-A-63 060 265 (Mitsubishi Metal Corp.) Mar. 16, 1988 * abstract*.

Patent Abstracts of Japan, vol. 13, No. 420 (M-872) Sep. 19, 1989 & JP-A-11 59 479 Mazda Motor Corp.) Jun. 22, 1989 * abstract*.

Chemical Abstracts, vol. 111, No. 18, Columbus, Ohio, U.S., abstract No. 158773, Akechi, Kiyoaki, "Extrusion of Aluminum Alloy for Rotors", * abstract *, & JP-A--1-005 621 (Sumitomo Electric Ind. Ltd.), Jan. 10, 1989.

Chemical Abstracts, vol. 116, No. 6, Columbus, Ohio, US, abstract No. 45113, Kyota Fumio et al. "Aluminum Alloy Rotors", * abstract * & JP-A-3 111 531 (Riken Corp.) May 13, 1991.

Chemical Abstracts, vol. 111, No. 20, Columbus, Ohio, US, abstract No. 179275, Akechi, Kiyoaki, "Compressor Rotor From Processing of Aluminum Alloy Powder", *abstract* & JP-A-1 011 911 (Sumitomo Electric Ind. Ltd.) Jan. 17, 1989.

Chemical Abstracts, vol. 102, No. 6, Columbus, Ohio, US, abstract No. 53072, "Air Pump" * abstract * & JP-A-59 136 497 (Tokyo Kogyo Co., Ltd., Fuchu) Aug. 6, 1984.

*Primary Examiner*—Richard O. Dean
*Assistant Examiner*—Sean Vincent
*Attorney, Agent, or Firm*—Cushman, Darby & Cushman

[57] ABSTRACT

An oil pump comprises a casing of aluminum alloy and at least one rotor housed therein. The rotor is produced by powder metallurgical with a rapidly solidified aluminum alloy comprising, by weight, of 5 to 25% of Si, up to 15% of one or more alloy elements selected from the group consisting of 3 to 10% of Fe, 3 to 10% of Ni and 1 to 8% of Cr, and the balance of Al and inevitable impurities. The casing may be produced by powder metallurgy or ingot metallurgy with an aluminum alloy consisting essentially, by weight, of 5 to 25%, preferably 5 to 17%, of Si, 1 to 5% of Cu, 0.2 to 1.5% of Mg, 0.2 to 1% of Mn, and the balance of Al and inevitable impurities. The rotor and casing are so combined that the sum of the Si content of said rapidly solidified aluminum alloy for casing and that of said rapidly solidified aluminum alloy for rotor being equal to or more than 15 percent by weight.

7 Claims, 2 Drawing Sheets

OIL PUMP MADE OF ALUMINUM ALLOYS

BACKGROUND OF THE INVENTION

1. Field of the Invention

The present invention relates to an oil pump made of aluminum alloys and, more particularly, an oil pump comprising at least one rotor of a powder metallurgical aluminum alloy in a stationary casing of an aluminum alloy, which is improved in wear resistance and mechanical strength at elevated temperature.

2. Description of the Prior Art

Recently, component parts of automobiles have been made lighter as one of the countermeasures against fuel consumption of automobiles and oil pumps for automobiles are no exception to the rule. The oil pumps are usually made of iron and comprises a stationary casing produced by molding or die-casting. Thus, the oil pumps, for example, those for automatic transmission system, have a weight of 5 kg and above. If aluminum alloys are used as a material for the component parts of oil pumps, the weight complete of oil pumps would be lightened to less than 2 Kg and the weight would be reduced by about 60%. In addition, further improvement in performance of the oil pumps is expected by lightening of the component parts.

However, old aluminum alloys which have been put into practical applications cannot be applied to rotors of oil pumps because of their poor wear resistance. For example, ingot metallurgical aluminum alloys such as AC8B and A390 (hereinafter referred to as I/M Al alloys), usually used for pistons, bearings or like parts, are materials developed in consideration of wear resistance. If such I/M Al alloys are used as a material for the rotors of oil pumps, considerable wears and damages caused by pitching wear take place at tooth flanks of the rotors because of their poor resistance to sliding wear and pressing fatigue. Further, seizing wears take place at edges and peripheries of the rotor considerably because of the sliding contact between rotor and casing. In addition, at the high rotational speed of the rotors, fatigue failure takes place at the shaft joint because of lack of strength.

Further, it is impossible with the cold forging operation to produce precision parts with a complex configuration, so that the cold forging of aluminum alloys require machining. As the content of Si in aluminum alloys increases, the machinability of the aluminum alloy decreases because of increasing particle size of primary crystals of Si, resulting in lowering of strength and toughness. In addition, aluminum alloys are required to have a content of 3 to 10 percent by weight of Fe to improve the strength at elevated temperatures, but the Fe content of more than 5% causes formation of large acicular crystal structure, resulting in decrease of the toughness. Accordingly, it is impossible to produce aluminum alloys with a sufficient strength at elevated temperatures.

Powder metallurgical aluminum alloys, i.e., aluminum alloys produced by powder metallurgy with a rapidly solidified aluminum alloy powder (hereinafter referred to as P/M aluminum alloys), such as high-Si aluminum alloys containing 20 to 40% by weight of Si, are poor in the strength at elevated temperature, thus making it difficult to apply them to rotors of oil pumps for automatic transmissions, which are operated at elevated temperatures of about 150° C.

In order to improve the wear resistance of the P/M aluminum alloys, attempts have been made to replace Si with hard particles such as SiC, TiC, $Al_2O_3$ and so on. However, these P/M aluminum alloys have a problem similar to that of the high Si aluminum alloys. For example, in case of that the P/M aluminum alloy are applied to rotors of the oil pumps, the matrix thereof begins to soften when heated to more than 100° C. by frictional heat. For this reason, the aluminum alloy is apt to be damaged because of lowering of strength. At the same time, the hard particles are left out by shearing force acting on the rotor during sliding movement of the rotors, so that wear resistance becomes lowered.

Also, P/M aluminum alloys of a Al-high Zn system have high strength at elevated temperatures because of their considerable age hardening, but they are poor in wear resistance. Thus, they cannot be adapted for rotors of oil pumps.

In JP-A-60-147785 and JP-A-62-124284, it has been proposed to provide protective coatings by anodic oxidation, nickel plating or chrome plating on rotors of sintered aluminum alloys to improve the wear resistance thereof. Under high-speed sliding motions of the rotors, however, the coatings come off or are damaged together with the matrix because of softening of the aluminum alloys at elevated temperature, resulting in seizing of rotor and casing. In addition, such aluminum alloys are required to control the thickness of coating accurately to improve the pump efficiency, resulting in increase in the production cost.

On the other hand, the stationary casings are required to have a coefficient of thermal expansion close to that of the rotors to provide a high pump efficiency. If the coefficient of thermal expansion of casing differs greatly from that of the rotor, a clearance between them increases with temperature, resulting in lowering of the pump efficiency. Also, the stationary casings are required to have a wear resistance close to that of the rotors to control the increase of clearance between them due to wear of the casing.

To meet such requirements, the inventors have tried to produce a casing of oil pump with a powder metallurgical material such as rapidly solidified Al-Si alloys. However, if the casing of a rapidly solidified Al-Si alloy is used in combination with the rotor of the rapidly solidified P/M aluminum alloy, it is apt to cause seizing and adhesive wear of the oil pump.

SUMMARY OF THE INVENTION

It is therefore an object of the present invention to provide an oil pump of aluminum alloys with high strength and high wear resistance.

Another object of the present invention is to provide an oil pump with an improved pump efficiency, comprising at least one rotor of a rapidly solidified, powder metallurgical aluminum-silicon alloy in a stationary casing of Al-Si alloy produced by powder metallurgy or ingot metallurgy.

According to the present invention, the above and other objects are achieved by providing an oil pump comprising a casing and at least one rotor housed therein, said casing being of an aluminum alloy consisting essentially, by weight, of 5 to 25%, preferably 5 to 17%, of Si, 1 to 5% of Cu, 0.2 to 1.5% of Mg, 0.2 to 1% of Mn, and the balance of Al and inevitable impurities, said rotor being produced by powder metallurgy with a rapidly solidified aluminum alloy comprising, by weight, of 5 to 25% of Si, up to 15% of one or more alloy elements selected from the group consisting of 3 to 10% of Fe, 3 to 10% of Ni and 1 to 8% of Cr, and the balance of Al and inevitable impurities, the sum of the Si content of said rapidly solidified aluminum alloy for casing and that of said rapidly solidified aluminum alloy for rotor being equal to or more than 15 percent by weight.

The casing may be produced by powder metallurgy with a rapidly solidified aluminum alloy consisting essentially, by weight, of 5 to 25%, preferably 5 to 17%, of Si, 1 to 5 % of Cu, 0.2 to 1.5% of Mg, 0.2 to 1% of Mn, and the balance of Al and inevitable impurities, or by ingot metallurgy with an aluminum alloy consisting essentially, by weight, of 5 to 25%, preferably 5 to 17%, of Si, 1 to 5% of Cu, 0.2 to 1.5% of Mg, 0.2 to 1% of Mn, and the balance of Al and inevitable impurities.

DETAILED DESCRIPTION OF THE INVENTION

The pumps to which the present invention is mainly applied are internal gear pumps comprising an inner rotor and an outer rotor with a tooth flank of a trochoid curve, involute curve, hypo-cycloid curve, or the like. However, the present invention is applied effectively to any other pumps operated under severe conditions, for example, such as general gear pumps, pumps employing scroll type rotors, and the like.

As mentioned above, the rotors used in the present invention is basically made of a rapidly solidified, powder metallurgical aluminum alloy comprising, by weight, of 5 to 25% of Si, up to 15% of one or more alloy elements selected from the group consisting of 3 to 10% of Fe, 3 to 10% of Ni and 1 to 8% of Cr, and the balance of Al and inevitable impurities. However, the aluminum alloy for rotors may further contain up to 5% by weight of a third alloy element composed of at least one element selected from the group consisting of Mo, V and Zr. Also, the aluminum alloy for rotors may further contain 1 to 5% of Cu, 0.2 to 1.5% of Mg, and 0.2 to 1% of Mn, along with or without up to 5% by weight of a third alloy element composed of at least one element selected from the group consisting of 1 to 5% of Mo, 1 to 5% of V, and 1 to 5% of Zr.

In a preferred embodiment, the rotors are made of a rapidly solidified, powder metallurgical aluminum alloy consisting essentially, by weight, of (a) 5 to 25% of a primary alloy element composed of Si; (b) 1 to 15% of one or more secondary alloy elements selected from the group consisting of Fe, Ni and Cr, the sole content of Fe being 3 to 10% of Fe, the sole content of Ni being 3 to 10%, the sole content of Cr being 1 to 8%; (c) 1 to 5% of one or more third alloy elements selected from the group consisting of Mo, V and Zr; and (e) the balance of Al and inevitable impurities.

In another preferred embodiment, the rotors are made of a rapidly solidified, powder metallurgical aluminum alloy consisting essentially, by weight, of (a) 5 to 25% of a primary alloy element composed of Si; (b) 1 to 15% of one or more secondary alloy elements selected from the group consisting of Fe, Ni and Cr, the sole content of Fe being 3 to 10% of Fe, the sole content of Ni being 3 to 10%, the sole content of Cr being 1 to 8%; (d) 1.4 to 7.5% of a fourth alloy element composed of Cu, Mg and Mn, the sole content of Cu being 1 to 5%, the sole content of Mg being 0.2 to 1.5%, the sole content of Mn being 0.2 to 1%; and (e) the balance of Al and inevitable impurities.

In still another preferred embodiment, the rotors are made of a rapidly solidified, powder metallurgical aluminum alloy consisting essentially, by weight, of (a) 5 to 25% of a primary alloy element composed of Si; (b) 1 to 15% of one or more secondary alloy elements selected from the group consisting of Fe, Ni and Cr, the sole content of Fe being 3 to 10% of Fe, the sole content of Ni being 3 to 10%, the sole content of Cr being 1 to 8%; (c) 1 to 5% of one or more alloy elements selected from the group consisting of Mo, V and Zr; (d) 1.4 to 7.5% of a fourth alloy element composed of Cu, Mg and Mn, the sole content of Cu being 1 to 5%, the sole content of Mg being 0.2 to 1.5%, the sole content of Mn being 0.2 to 1%; and (e) the balance of Al and inevitable impurities.

The rotors used for the oil pumps of the present invention may be produced by a process comprising the steps of preforming a rapidly solidified aluminum alloy power into a compact with a relative density of 75 to 90% under cool or warm conditions, heating and degassing the compact in an inert gas atmosphere at a temperature of from 300° C. to 560° C. for 0.25 to 3 hours, and hot-coining the compact to prepare a solidified body with a porosity of 2 to 5%. The thus produced rotors may be finished by hot-die forging and then seizing as occasion demands.

In the above process, the heat-treatment of the compacts is carried out in an atmosphere of an inert gas such as nitrogen, argon and the like to completely remove moisture and organic compounds absorbed to particles of the alloy powder as well as to prevent the particles from formation of aluminum oxide films due to reaction of water and aluminum. However, if the heat treatment is carried out at a temperature higher than 560° C. or for a long time exceeding 3 hours, the aluminum alloy loosens its excellent properties given by rapid solidification, resulting in lowering of the mechanical properties required for the rotors of oil pumps. It is preferred to solidify the rotor with a porosity of 5% or below to prevent it from formation of continuous pores which cause decrease in mechanical strength and oxidation of the alloy.

The reasons why the composition of the aluminum alloy for the casing has been limited to the above range are explained below along with function of each alloy element.

A primary alloy element, Si, is uniformly dispersed in the matrix by rapid solidification in the form of fine crystals with a particle size of not more than 10 μm to improve the wear resistance and a resistance to sliding abrasive wear properties when the casing is used in combination with the rotor composed of the above composition, as well as to improve the mechanical strength and hardness of the alloy per se. If the Si content is less than 5%, its addition takes no recognizable effects. If the Si content exceeds 25%, the particle size of Si becomes large, resulting in decrease in the mechanical strength and toughness of the alloy and lowering of the forging properties of the powder. Thus, the content of Si has been limited to values ranging from 5 to 25%, preferably, 5 to 17%.

The molded casing of an Al-Si system produced by casting or die casting contains particulate of Si uniformly dispersed in the matrix of Al, and these particulate have a mean particle size of 30 to 100 μm and contribute to improve the mechanical properties of the alloy and the sliding properties and wear resistance of the cases when used in combination with the rotors made of the rapidly solidified, powder metallurgical aluminum alloy.

The secondary alloy element, i.e., Cu, Mg and Mn, are respectively incorporated into the matrix to improve the mechanical properties such as mechanical strength and toughness. If the content of Cu is less than 1%, its addition provides insufficient effects. If the content of Cu exceeds 5%, it provides no further effect to improve the properties but causes lowering of corrosion resistance. If the content of Mg is less than 0.2%, its addition provides insufficient effects. If the content of Mg exceeds 1.5%, it provides no further effect to improve the properties but causes increase in size of precipitations, resulting in lowering of mechanical strength and toughness. If the content of Mn is less than 0.2% or exceeds 1%, it provides the same results as those produced by the addition of Mg. For these reasons, the content of these alloy elements have been limited to the above respective ranges, i.e., 1 to 5% for Cu, 0.2 to 1.5% for Mg, and 0.2 to 1% for Mn.

Then, the reasons why the composition of the aluminum alloy for the rotors has been limited to the above range are explained below along with function of each alloy element.

Si is uniformly dispersed in the matrix of Al in the form of fine particles to improve the wear resistance as well as to prevent the grain growth of the compounds of Al with transition elements mentioned below. Also, the uniform dispersion of Si in the matrix contributes to improve the mechanical strength and hardness of the alloy. If the content of Si is less than 5%, it is insufficient to provide good wear resistance under the relative sliding contact. If the Si content exceeds 25%, the particle size of Si becomes large, resulting in decrease in the mechanical strength and toughness of the alloy and lowering of the forging properties of the powder.

In this case, it is important for the Si content to meet the following condition: $(W_r+W_c)\geqq 15\%$ where $W_r$ is the content of Si in the aluminum alloy used for the casing, and $W_c$ is the content of Si in the aluminum alloy used for the rotor. The crystal grains of Si uniformly dispersed in the matrixes of both the alloys come into contact with each other and prevent the matrixes from direct contact, thereby improving the wear resistance and sliding movement properties. If the sum of the Si content in the aluminum alloy for the casing and the Si content in the aluminum alloy for the rotor, i.e., $W_r+W_c$, is less than 15%, the surface area where both the matrixes come into contact directly each other becomes large and plastic deformation takes place on either or both the surface of the matrixes by external forces applied, which in turn causes seizing or adhesive wear. Thus, it is impossible to produce oil pumps which can be put into practical use.

Fe forms intermetallic compounds with Al, for example, $FeAl_3$, to improve the mechanical strength at elevated temperature. If the content of Fe is less than 3%, its addition takes insufficient effects. If the content of Fe exceeds 10%, the grain size of the intermetallic compound becomes large, resulting in decrease in the mechanical strength of the products.

Ni forms intermetallic compounds with Al, for example, NiAl and $NiAl_3$, like as Fe, to improve the mechanical strength at elevated temperature. If the content of Ni is less than 3% or exceeds 10%, it causes the problems similar to those described above for Fe.

Cr per se is finely dispersed in the matrix and forms intermetallic compounds with Al, for example, $CrAl_3$, to improve the mechanical strength at elevated temperature. Also, the addition of Cr improves the corrosion resistance. If the content of Cr is less than 1%, its addition takes insufficient effects. If the content of Cr exceeds 8%, its addition has no further effect on the improvement of the properties and the size of the crystal grains becomes large, resulting in decrease in the mechanical strength and toughness.

The above transition metal elements, i.e., Fe, Ni and Cr may be used alone or in combination. In combined use, these elements are preferably incorporated into the matrix in an amount of up to 15%. Because, the sum of the contents of these elements exceeding 15% provides no further effect but causes such a disadvantage that, when producing the aluminum alloy powder, it is required to carry out the solid solution treatment at higher temperature because of increase in the content of the alloy elements with a high melting point. This results in increase in production cost.

Mo, V and Zr are uniformly dispersed in the matrix of Al in the form of fine particles to improve the mechanical strength of the matrix. If the content of each elements is less than 1%, its addition takes no recognizable effects. If the sum of added amounts of these elements exceeds 5%, the notch sensitivity of the dispersed particles becomes large, resulting in decrease in the mechanical strength of the products.

Cu, Mg and Mn are incorporated into the matrix to improve the mechanical properties such as strength and hardness. At the same time, the sedimenting particulate of these elements control the grain growth of the compounds of transition metals (i.e., Fe, Ni and Cr) with Al. If the content of Cu is less than 1%, its addition takes no recognizable effects. If the content of Cu exceeds 5%, its addition provides no further effect but causes lowering of corrosion resistance. If the content of Mg is less than 0.2 %, its addition takes no recognizable effects. If the content of Mg exceeds 1.5%, its addition provides no further effect but causes formation of large-sized particulate, resulting in lowering of the strength and toughness. If the content of Mn is less than 0.2%, its addition takes no recognizable effects. If the content of Mn exceeds 1%, there is no further increase in effect but it causes lowering of the strength and toughness because of formation of large-sized particulate.

The I/M alloys have no rapid solidification effect even if they have the same composition as the P/M alloys, thus making it impossible to obtain a high mechanical strength. For this reason, only the P/M alloys are used as a material for the rotors in the present invention.

The mechanical strength of the rapidly solidified, powder metallurgical aluminum alloys used for the pump rotors may be improved by the known thermal treatment such as T-4, T-6 and the like as occasion demands. Such a thermal treatment is usually carried out after solidification of the alloy.

These and other objects and features of the present invention will become clear from the following description taken in conjunction with the preferred embodiments thereof.

EXAMPLE 1

Figure 1:
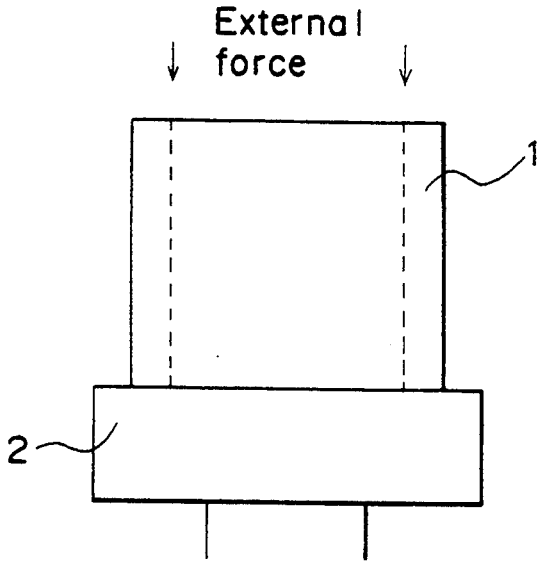
FIG. 1 is a side view of a system for abrasion test.

Using rapidly solidified aluminum alloy powders each having a composition shown in Table 1, there were prepared specimens for abrasion tests in the following manner: Each rapidly solidified aluminum alloy powder was preformed into compacts with a relative density of 75 to 93% under cool conditions and then degassed by heating the resultant compacts in an inert atmosphere at a temperature ranging from 300° C. to 560° C. for 0.25 to 3 hours. After degassing, the compacts were hot-coined to prepare solid bodies with a porosity of 2 to 5%, and then forged with hot dies to prepare rings 1 and plates 2 as shown in FIG. 1. Each ring 1 has an outer diameter of 23 mm, an inner diameter of 20 mm, and a height of 15 mm, while each square plate 2 has sides of 30 mm and a thickness of 6 mm.

In Table 1, specimens Nos. 1 to 10 are those having a composition which meets the requirements as a material for the rotors of the present invention, while asterisked specimens Nos. 11 to 17 are those having a composition which does not meet the requirements as a material for the rotors of the present invention.

Figure 2:
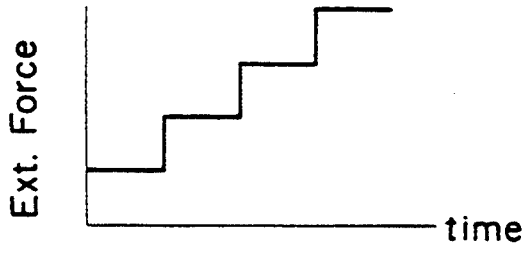
FIG. 2 is a graph illustrating test conditions of abrasion.

For each specimen, measurements were made on mechanical properties (tensile strength and elongation) and seizing property. The seizing test was carried out at a temperature of 50° to 120° C. with a thrust abrasion tester by applying an external force on the ring 1, while rotating the plate 2 at a speed of 3 m/sec, as shown in FIG. 1. A lubricating oil is supplied to a sliding contact between the ring and plate 2. The external force applied to the ring was increased by the step of 5 kgf every one minute until it reaches to 500 kgf, as shown in FIG. 2. Results are shown in Table 2.

Separate from the above, there were prepared specimens for abrasion test in the same manner as above, using rapidly solidified, Al-Si alloys for casings, each having a composition shown in Table 3. For each specimen, the seizing test was carried in the same manner as above in combination with the specimens Nos. 1, 2, 4, 6, 9 and 10 of Table 1. Results are shown in Table 3.

TABLE 1

| Specimen | Composition of rapidly solidified aluminum alloy powder for rotors | | | | | | | | | | |
|---|---|---|---|---|---|---|---|---|---|---|---|
| No. | Si | Fe | Ni | Cr | Cu | Mg | Mn | Mo | V | Zr | Balance |
| 1 | 8 | 5 | 6 | 1 | 0 | 0 | 0 | 0 | 0 | 0 | Al with impurities |
| 2 | 8 | 5 | 6 | 1 | 3.5 | 1.0 | 0.5 | 0 | 0 | 0 | Al with impurities |
| 3 | 11 | 6 | 5 | 0 | 0 | 0 | 0 | 0 | 0 | 0 | Al with impurities |
| 4 | 11 | 6 | 5 | 0 | 0 | 0 | 0 | 1 | 1 | 1 | Al with impurities |
| 5 | 20 | 6 | 6 | 0 | 0 | 0 | 0 | 0 | 0 | 0 | Al with impurities |
| 6 | 20 | 6 | 6 | 0 | 0 | 0 | 0 | 1 | 1 | 0 | Al with impurities |
| 7 | 24 | 4 | 8 | 1 | 0 | 0 | 0 | 0 | 0 | 0 | Al with impurities |
| 8 | 24 | 4 | 8 | 1 | 4.0 | 0.5 | 0.5 | 0 | 0 | 0 | Al with impurities |
| 9 | 5 | 8 | 6 | 0 | 0 | 0 | 0 | 0 | 0 | 0 | Al with impurities |
| 10 | 5 | 8 | 6 | 0 | 3.5 | 1.0 | 0.5 | 1 | 1 | 0 | Al with impurities |
| 11 | *3 | 8 | 6 | 0 | 3.5 | 1.0 | 0.5 | 1 | 1 | 0 | Al with impurities |
| 12 | *30 | 5 | 5 | 1 | 4.5 | 0.5 | 0.5 | 1 | 1 | 1 | Al with impurities |
| 13 | 15 | *15 | 0 | 0 | 3.5 | 1.0 | 0.5 | 1 | 1 | 0 | Al with impurities |
| 14 | 15 | 40 | *14 | 0 | 3.5 | 0.5 | 0.5 | 1 | 1 | 0 | Al with impurities |
| 15 | *15 | *8 | *8 | 5 | 4.0 | 1.0 | 0.5 | 1 | 1 | 0 | Al with impurities |
| 16 | *15 | *0 | *0 | 0 | 3.5 | 0.5 | 0.5 | 1 | 2 | 1 | Al with impurities |
| 17 | 15 | 5 | 6 | 2 | 3.5 | 1.0 | 0.5 | *3 | *3 | *2 | Al with impurities |

TABLE 2

| Specimen | Tensile strength (kgf/mm$^2$) | | | Elongation | Seizing load |
|---|---|---|---|---|---|
| No. | Ordinary temp. | 100° C. | 200° C. | (%) | (kgf) |
| 1 | 55.1 | 51.3 | 43.1 | 1.6 | 380 |
| 2 | 54.0 | 50.2 | 43.5 | 1.8 | 375 |
| 3 | 54.3 | 52.7 | 43.2 | 1.7 | 395 |
| 4 | 55.2 | 52.1 | 44.7 | 1.5 | 390 |
| 5 | 56.4 | 53.1 | 44.4 | 1.2 | 430 |
| 6 | 57.0 | 52.4 | 45.9 | 1.4 | 425 |
| 7 | 59.0 | 54.1 | 46.9 | 1.1 | 440 |
| 8 | 58.2 | 53.6 | 47.6 | 1.1 | 450 |
| 9 | 50.9 | 47.2 | 44.2 | 2.2 | 400 |
| 10 | 51.5 | 48.5 | 43.0 | 2.1 | 395 |
| 11 | 53.2 | 49.5 | 44.0 | 2.6 | 225 |
| 12 | 45.0 | 41.5 | 35.2 | 0 | 485 |
| 13 | 47.5 | 43.0 | 37.8 | 0.2 | 420 |
| 14 | 46.4 | 42.5 | 36.6 | 0.4 | 415 |
| 15 | 44.7 | 41.6 | 35.5 | 0.2 | 450 |
| 16 | 45.8 | 36.5 | 27.6 | 1.0 | 425 |
| 17 | 43.6 | 39.2 | 33.5 | 0.1 | 430 |

TABLE 3

| Test | Alloy for rotor | | Al—Si alloy for casing | | | Seizing |
|---|---|---|---|---|---|---|
| No. | Alloy No. | Si content $W_r$ (%) | Grain size of Si (μm) | Si Content Wr (%) | $W_r + W_c$ (%) | load (kgf) |
| 1 | 1 | 8 | 3 | 3 | 15 | 385 |
| 2 | 1 | 8 | 4 | 12 | 20 | 415 |
| 3 | 1 | 8 | 5 | 16 | 24 | 435 |
| 4 | 1 | 8 | 7 | 25 | 33 | 475 |
| 5 | 4 | 11 | 3 | 7 | 18 | 400 |
| 6 | 4 | 11 | 4 | 12 | 23 | 420 |
| 7 | 4 | 11 | 5 | 16 | 27 | 455 |
| 8 | 6 | 20 | 4 | 12 | 32 | 490 |
| 9 | 6 | 20 | 5 | 16 | 36 | 500 |
| 10 | 6 | 20 | 7 | 25 | 45 | 500 |
| 11 | 1 | 8 | 3 | 5 | *13 | 270 |
| 12 | 2 | 8 | 3 | 5 | *13 | 280 |
| 13 | 9 | 5 | 3 | 7 | *12 | 275 |
| 14 | 10 | 5 | 3 | 5 | *10 | 245 |

As will be understood from the results shown in Table 2, the alloy for rotors with the Si content of less than 5%, like as specimen No. 11, is poor in seizing property. Also, it will be seen that the alloy of which the content of Si exceeds 25% like as specimen No. 12, the alloy of which the content of Fe exceeds 13% like as specimen No. 13, the alloy of which the content of Ni exceeds 10% like as specimen No. 14, the alloy of which the sum of the contents of Fe, Ni and Cr exceeds 15% like as specimen No. 15, and the alloy of which the sum of the contents of Mo, V and Zr exceeds 5% like as specimen No. 17, are considerably low in toughness (elongation). Further, it will be seen that the alloys containing no transition metal elements like as specimen No. 16 is bad in tensile strength at elevated temperature.

As will be understood from the results shown in Table 3, good results are obtained only when the alloy for rotors is used in combination with the Al-Si alloy for casing so that the sum of the Si contents of both the alloys exceeds 15%.

EXAMPLE 2

Figure 3:
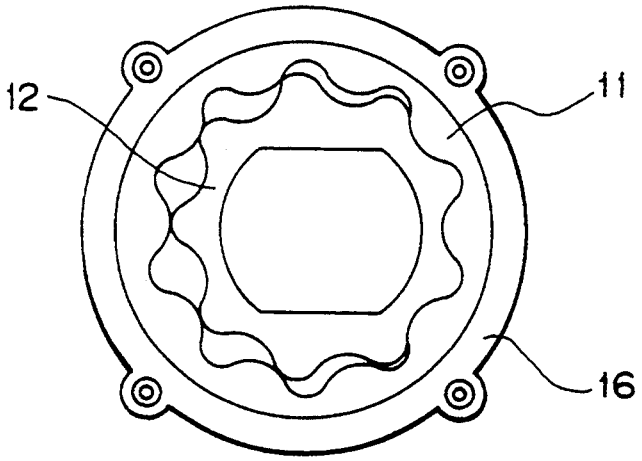
FIG. 3 is a side view of a pump embodying the present invention with a casing lid being removed.

Using each rapidly solidified aluminum alloy powder of specimen Nos. 1, 3, 11 and 12 in Table 1, there were prepared outer rotors 3 and inner rotors 4 for an oil pump as shown in FIG. 3 in the following manner: Each alloy powder was preformed into inner and outer compacts with a relative density of 75 to 93% under cool conditions. The compacts were degassed by heating in an inert atmosphere at a temperature of 300° to 560° C. for 0.25 to 3 hours, hot-coined to prepare solid bodies with a porosity of 2 to 5%, and then forged with hot dies to prepare inner and outer rotors having a tooth flank as shown in FIG. 3.

Separate from the above, using rapidly solidified Al-Si alloy powder having a composition shown in Table 4, there were prepared casings 5 as shown in FIG. 3 in the same manner as above.

Then, there were prepared oil pumps each having a combination of the outer and inner rotors 3, 4 and the casing 5 as shown in Table 4. For each oil pump, performance measurement was carried out under the following conditions. Results are summarized in Table 4.

Test conditions:

Revolution of pump: 4000–6500 rpm

Inlet pressure: 20 kg/cm$^2$

Oil used: Lubricating oil ATF at 120° C.

Test time: 50 hours

TABLE 4

| | Alloy For ROTOR | | Al—Si alloy for casing | | |
|---|---|---|---|---|---|
| Pump | outer rotor | inner rotor | Si size (μm) | Si content Wc (%) | Pump test |
| (a) | 1 | 1 | 4 | 12 | ◎ |
| (b) | 1 | 3 | 4 | 12 | ◎ |
| (c) | 3 | 3 | 4 | 12 | ◎ |
| (d) | 1 | 1 | 5 | 16 | ◎ |
| (e) | 1 | 3 | 5 | 16 | ◎ |
| (f) | 3 | 3 | 5 | 16 | ◎ |
| (g) | 11 | 11 | 4 | 12 | Δ/∇ |
| (h) | 12 | 12 | 4 | 12 | x |
| (i) | 1 | 1 | 3 | 5 | Δ |
| (j) | 1 | 3 | 3 | 5 | Δ |
| (k) | 3 | 3 | 3 | 5 | ◎ |

In Table 4, ◎ means that the pump has good performances and possesses no wear and damage at sliding portions, Δ means that adhesion wear occurred between the outer rotor and casing, ∇ means that adhesion wear or scratches were found on teeth portion of rotors, and × means that rotor was broken during sliding movement.

As will be understood from the data shown in Table 4, good results are obtained only when the rotors made of rapidly solidified aluminum alloy powder of specimen Nos. 1 or 3 in Table 1 are combined with the casing of Al-Si alloy with the Si content of 5 to 25% in such a manner that the sum of the Si content of the alloy for casing and that of the alloy for rotor is equal to or more than 15%.

EXAMPLE 3

Using I/M aluminum alloys of a Al-Si system each consisting, by weight, of 5 to 25% of Si, 1 to 5% of Cu, 0.2 to 1.5% of Mg, 0.2 to 1% of Mn, and the balance of Al and inevitable impurities, there were prepared specimens for abrasion test in the form of a square plate with 4-sides of 30 mm and a thickness of 6 mm.

For each specimen, the seizing test was carried in the same manner as Example 1 in combination with the rings prepared in Example 1 by using alloys of specimens Nos. 1, 2, 4, 6, 9 and 10 of Table 1. Results are shown in Table 5.

TABLE 5

| | Alloy for rotor | | Alloy for casing | | | |
|---|---|---|---|---|---|---|
| specimen | Alloy No. | Si content Wr (%) | Si grain size (μm) | Si Content Wc (%) | Wr + Wc (%) | seizing load (kgf) |
| 1 | 1 | 8 | 30–60 | 7 | 15 | 385 |
| 2 | 1 | 8 | 30–80 | 10 | 18 | 415 |
| 3 | 1 | 8 | 30–90 | 15 | 23 | 435 |
| 4 | 1 | 8 | 30–100 | 17 | 25 | 475 |
| 5 | 4 | 11 | 30–60 | 7 | 18 | 400 |
| 6 | 4 | 11 | 30–80 | 10 | 21 | 420 |
| 7 | 4 | 11 | 30–90 | 15 | 26 | 455 |
| 8 | 6 | 20 | 30–80 | 10 | 30 | 490 |
| 9 | 6 | 20 | 30–90 | 15 | 35 | 500 |
| 10 | 6 | 20 | 30–100 | 17 | 37 | 500 |
| 11 | 1 | 8 | 30–50 | 5 | 13 | 250 |
| 12 | 2 | 8 | 30–50 | 5 | 13 | 260 |
| 13 | 9 | 5 | 30–60 | 7 | 12 | 240 |
| 14 | 10 | 5 | 30–50 | 5 | 10 | 205 |

EXAMPLE 4

Using each rapidly solidified aluminum alloy powder of specimen Nos. 1, 3, 11 and 12 in Table 1, there were prepared outer rotors 3 and inner rotors 4 for an oil pump as shown in FIG. 3 in the same manner as Example 2.

There were prepared casings 5 as shown in FIG. 3 by die casting, using I/M aluminum alloys of a Al-Si system having a composition as shown in Table 6. Each alloy consists, by weight, of 5 to 25% of Si, 1 to 5% of Cu, 0.2 to 1.5% of Mg, 0.2 to 1% of Mn, and the balance of Al and inevitable impurities.

The casings was combined with outer and inner rotors 3, 4 prepared in Example 2 to prepare oil pumps each having a combination of rotors and casing as shown in Table 6. For each oil pump, performance measurement was carried out under the following conditions. Results are summarized in Table 6.

Test conditions:

Revolution of pump: 4000–6500 rpm

Inlet pressure: 20 kg/cm$^2$

Oil used: Lubricating oil ATF at 120° C.

Test time: 50 hours

TABLE 6

| | Alloy For ROTOR | | Al—Si alloy for casing | | |
|---|---|---|---|---|---|
| pump | outer rotor | inner rotor | Si size (μm) | Si content Wc (%) | pump test |
| (a') | 1 | 1 | 30–80 | 10 | ◎ |
| (b') | 1 | 3 | 30–80 | 10 | ◎ |
| (c') | 3 | 3 | 30–80 | 10 | ◎ |
| (d') | 1 | 1 | 30–90 | 15 | ◎ |
| (e') | 1 | 3 | 30–90 | 15 | ◎ |
| (f') | 3 | 3 | 30–90 | 15 | ◎ |
| (g') | 11 | 11 | 30–80 | 10 | Δ/∇ |
| (h') | 12 | 12 | 30–80 | 10 | x |
| (i') | 1 | 1 | 30–50 | 5 | Δ |
| (j') | 1 | 3 | 30–50 | 5 | Δ |
| (k') | 3 | 3 | 30–50 | 5 | ◎ |

Note:

◎: The pump has good performances and possesses no wear and damage at sliding portions.

Δ: Adhesion wear occurred between the outer rotor and casing.

∇: Adhesion wear or scratches were found on teeth portion of rotors.

x: The rotor was broken during sliding movement.

As will be understood from the data shown in Table 6, good results are obtained only when the rotors made of rapidly solidified aluminum alloy powder are combined with the casing made of the I/M Al-Si alloy with the Si content of 5 to 25% in such a manner that the sum of the Si content of the alloy for casing and that of the alloy for rotor is the equal to or more than 15%.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom impeller.

What is claimed is:

1. An oil pump of aluminum alloys, comprising a casing and at least one rotor housed therein, said casing being produced by powder metallurgy with a rapidly solidified aluminum alloy consisting essentially, by weight, of 5 to 25% of Si, 1 to 5% of Cu, 0.2 to 1.5% of Mg, 0.2 to 1% of Mn, and the balance of Al and inevitable impurities, said rotor being produced by powder metallurgy with a rapidly solidified aluminum alloy comprising, by weight, of 5 to 25% of Si, up to 15% of at least one alloy element selected from the group consisting of 3 to 10% of Fe, 3 to 10% of Ni and 1 to 8% of Cr, and the balance of Al and inevitable impurities, the sum of the Si content of said rapidly solidified aluminum alloy for casing and that of aluminum alloy for rotor being equal to or more than 15%.

2. The oil pump according to claim 1, wherein said aluminum alloy for said rotor further contains 1 to 5% of Cu, 0.2 to 1.5% of Mg, 0.2 to 1% of Mn, and at least one additional alloy element selected from the group consisting of 1 to 5% of Mo, 1 to 5% of V, and 1 to 5% of Zr, the content of said additional alloy element being less than or equal to 5% by weight.

3. An oil pump of aluminum alloy comprising a casing and inner and outer rotors housed therein, said casing being produced by ingot metallurgy with an aluminum-silicon alloy consisting essentially, by weight, of 5 to 17% of Si, a secondary alloy element consisting of 1 to 5% of Cu, 0.2 to 1.5% of Mg and 0.2 to 1% of Mn, and the balance of Al and inevitable impurities, said inner and outer rotors being produced by powder metallurgy with a rapidly solidified aluminum alloy comprising, by weight,:

a first alloy element consisting of 5 to 25% of Si;

a secondary alloy element consisting of at least one element selected from the group consisting of 3 to 10% of Fe, 3 to 10% of Ni and 1 to 8% of Cr, the content of said secondary alloy element being equal to or less than 15%; and the balance of Al and inevitable impurities, the sum of the Si content of said aluminum alloy for the casing and that of the aluminum alloy for said rotors being equal to or more than 15%.

4. The oil pump according to claim 3, wherein said aluminum alloy for the rotors further contains 5% by weight of at least one third alloy element selected from the group consisting of Mo, V and Zr.

5. The oil pump according to claim 3, wherein said aluminum alloy for rotors further contains a third alloy element composed of 1 to 5% of Cu, 0.2 to 1.5% of Mg, and 0.2 to 1% of Mn.

6. The oil pump according to claim 3, wherein said aluminum alloy for said rotors further contains 1 to 5% of at least one third alloy element selected from the group consisting of 1 to 5% of Mo, 1 to 5% of V, and 1 to 5% of Zr, and a fourth alloy element composed of 1 to 5% of Cu, 0.2 to 1.5% of Mg, and 0.2 to 1% of Mn.

7. The oil pump according to claim 1, wherein said rotors is produced by a process comprising the steps of preforming a rapidly solidified aluminum alloy power into a compact with a relative density of 75 to 90% under cool or warm conditions, heating and degassing the compact in an inert gas atmosphere at a temperature of from 300° C. to 560° C. for 0.25 to 3 hours, and hot-coining the compact to prepare a solidified body with a porosity of 2 to 5%.

* * * * *